US005528976A

United States Patent [19]

Ikeda et al.

[11] Patent Number: 5,528,976

[45] Date of Patent: Jun. 25, 1996

[54] SWASH PLATE TYPE COMPRESSOR WITH BEARING ASSEMBLY

[75] Inventors: Hayato Ikeda; Naoya Yokomachi; Satoshi Umemura; Kazuya Kimura; Hideo Mori; Hisato Kawamura; Akira Nakamoto, all of Kariya, Japan

[73] Assignee: Kabushiki Kaisha Toyoda Jidoshokki Seisakusho, Kariya, Japan

[21] Appl. No.: 342,713

[22] Filed: Nov. 21, 1994

[30] Foreign Application Priority Data

| | | | |
|---|---|---|---|
| Nov. 24, 1993 | [JP] | Japan | 5-293048 |
| Apr. 14, 1994 | [JP] | Japan | 6-076171 |
| May 2, 1994 | [JP] | Japan | 6-093483 |

[51] Int. Cl.[6] ..... F04B 27/08; F01B 3/00

[52] U.S. Cl. ..... 92/71; 74/60; 91/502; 417/269

[58] Field of Search ..... 92/71, 70; 91/499, 91/502; 74/60; 417/269

[56] References Cited

U.S. PATENT DOCUMENTS

| | | | |
|---|---|---|---|
| 3,817,660 | 6/1974 | Knowles et al. | 417/269 |
| 4,135,862 | 1/1979 | Degawa | 417/269 |
| 4,470,761 | 9/1984 | Mukai et al. | 92/71 X |
| 4,522,112 | 6/1985 | Nomura | 92/71 |
| 4,767,283 | 8/1988 | Ikeda et al. | 92/71 X |
| 4,880,360 | 11/1989 | Terauchi et al. | 417/269 X |
| 5,233,913 | 8/1993 | Muirhead | 92/71 |
| 5,252,032 | 10/1993 | Iwanami et al. | 417/269 X |
| 5,370,503 | 12/1994 | Terauchi | 74/60 X |
| 5,433,137 | 7/1995 | Ikeda et al. | 417/269 X |

FOREIGN PATENT DOCUMENTS

| | | | |
|---|---|---|---|
| 54-170410 | 5/1978 | Japan . | |
| 0142983 | 11/1980 | Japan | 417/269 |
| 4-112974 | 4/1992 | Japan | 417/269 |

*Primary Examiner*—John E. Ryznic
*Attorney, Agent, or Firm*—Brooks Haidt Haffner & Delahunty

[57] ABSTRACT

A compressor has a swash plate supported on a drive shaft for an integral rotation. The swash plate is coupled to a plurality of pistons reciprocally moveable in a cylinder block to compress gas therein. Reaction force of the compressed gas applied to the piston and causing axial load acting on the swash plate and the drive shaft is buffered by buffer structure. The buffer structure comprises a first bearing interposed between a first surface of the swash plate and the cylinder block. The buffer structure has a second bearing interposed between a second surface of the swash plate and the cylinder block. One of the bearings is arranged to be flexibly deformable to absorb the axial load while the other bearing is arranged to be rigid to receive the axial load and transmit the axial load to the cylinder block.

16 Claims, 10 Drawing Sheets

SWASH PLATE TYPE COMPRESSOR WITH BEARING ASSEMBLY

BACKGROUND OF THE INVENTION

1. Field of the Invention

The present invention generally relates to a swash plate type compressor, and, more particularly, to an improvement in the bearings that receive a load on the swash plate.

2. Description of the Related Art

In general, compressor units used in automobiles, trucks and the like are used to supply compressed gas to the vehicle's air conditioning system. One common type of compressor utilizes a swash plate design having a plurality of double-headed pistons. The swash plate type compressor has a pair of cylinder blocks 110A and 110B as shown in FIG. 13. A drive shaft 111 is rotatably supported by the pair of cylinder blocks 110A and 110B. A swash plate 112 is mounted on the drive shaft 111. Thrust bearings 113 are respectively located between annular pressure receiving rib portions 112*a*, provided on the front and rear surfaces of the swash plate 112, and pressure receiving rib portions 110*a* of the cylinder blocks 110A and 110B. Each-thrust bearing 113 has an annular inner race 113*a* and an annular outer race 113*b* which have different diameters.

The outer ends of both cylinder blocks 110A and 110B respectively abut housings 114 and 115. Bolts 116 securely fix the individual cylinder blocks 110A and 110B and the housings 114 and 115.

During the compressor's assembly, when the bolts 116 are tightened, each inner race 113*a* abuts on the associated pressure receiving rib portion 112*a* near its outer periphery. This bolt tightening action elastically deforms each inner race. The outer races 113*b* abut on the pressure receiving rib portions 110*a* of the cylinder blocks 110A and 110B in the vicinity of their inner peripheries.

When the swash plate 112 rotates, the pistons 117 reciprocate, compressing the refrigerant gas. The reaction force of the swash plate 112, in turn, acts as an axial load on the thrust bearings 113 via the pistons 117 and the swash plate 112. The axial load is applied to the thrust bearings 113 by pressure receiving rib portions 110*a*, 112*a*. Since the diameter of rib portion 112*a* is larger than that of rib portion 110*a*, a moment is created around the inner race 112*a* causing it to elastically deform when the axial load is applied to the bearings 113 by the swash plate 112. As schematically illustrated in FIG. 14, the thrust bearings 113 can be considered as equivalent to springs S positioned between both sides of the swash plate 112 and the cylinder blocks 110A and 110B.

At the time the refrigerant gas is compressed, however, the spring like action of the thrust bearings 113 sets up a vibration which is transmitted to the swash plate 112. Moreover, under conditions when the drive shaft rotates at high speeds, a high frequency vibration is created and contributes to the noise produced by the compressor.

Japanese Unexamined Utility Model Publication No. 54-170410 discloses the structure of another thrust bearing. According to this structure, both outer surfaces of the boss portions of the swash plate and the two support surfaces of the cylinder blocks are formed flat. Here, the thrust bearings are held rigid between the outer surfaces of the boss portions and the opposing support surfaces. This structure makes it difficult to adjust the amount of force needed to fasten the bolts 116 to the housings 114 and 115. For example, if aluminum alloy components are fastened by the bolts, the thermal expansion of the aluminum components increases the difficulty of adjusting the amount of force needed to fasten the bolts 116 to the housings 114 and 115.

Further, when some moment is applied to the swash plate due to the pressure of the compressed gas, an offset load is applied to the rollers in the thrust bearing. This hastens the wearing of the bearing. The worn thrust bearings, in turn, cause vibration and noise or power loss in the compressor.

SUMMARY OF THE INVENTION

Accordingly, it is an object of the present invention to provide a swash plate type compressor which reduces swash plate vibration using a very simple structure.

To achieve the foregoing and other objects and in accordance with the purpose of the present invention, there is provided a compressor having a swash plate supported on a drive shaft for an integral rotation. The swash plate is coupled to a plurality of pistons reciprocally moveable in a cylinder block to compress gas therein. Reaction force of the compressed gas applied to the piston and causing axial load acting on the swash plate and the drive shaft is buffered by buffer means. The buffer means comprises a first bearing interposed between a first surface of the swash plate and the cylinder block. The buffer means has a second bearing interposed between a second surface of the swash plate and the cylinder block. One of the bearings is arranged to be flexibly deformable to absorb the axial load while the other bearing is arranged to be rigid to receive the axial load and transmit the axial load to the cylinder block.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
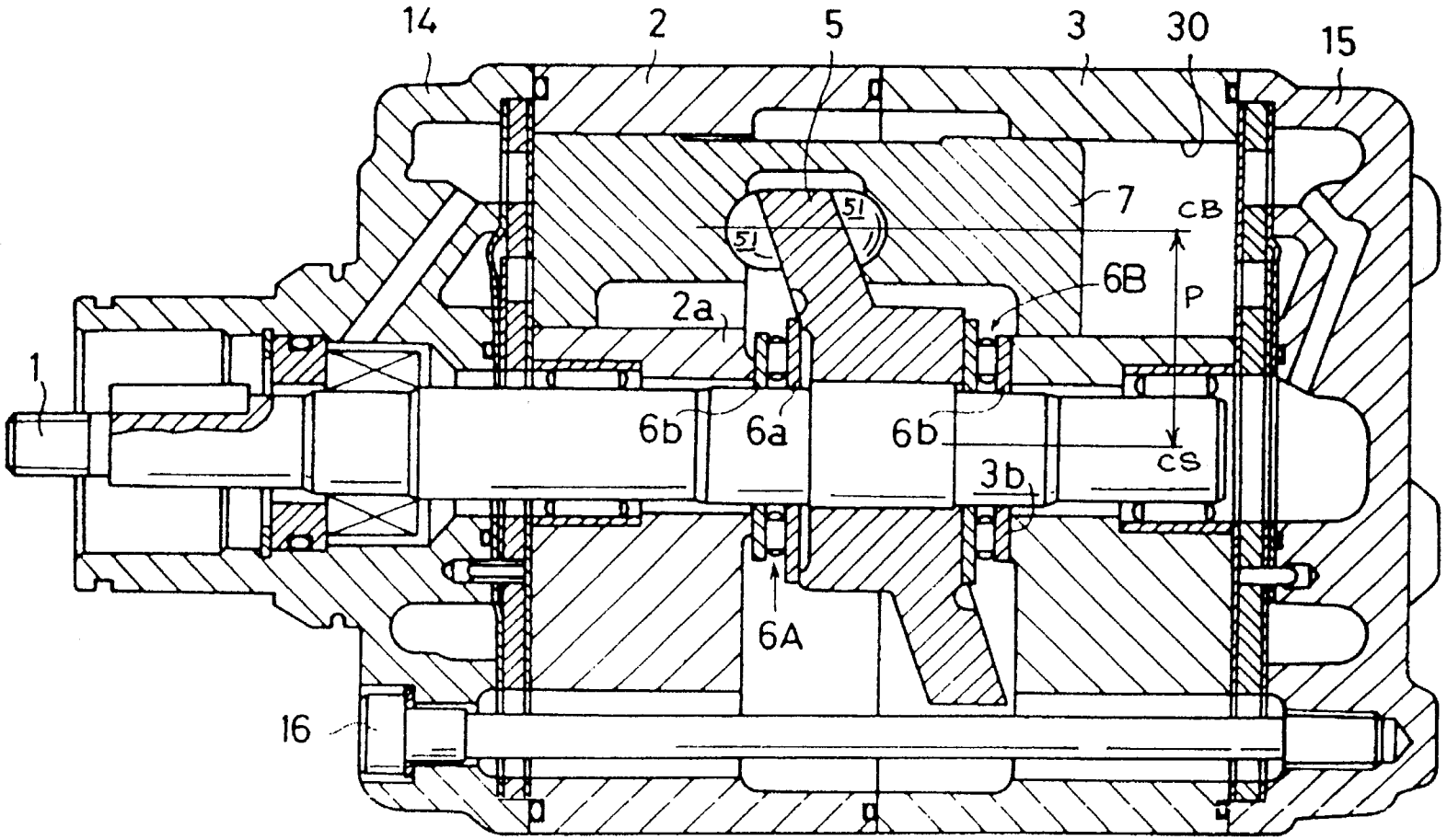
FIG. 1 is a cross-sectional view of a compressor according to a first embodiment of the present invention.
Figure 2:
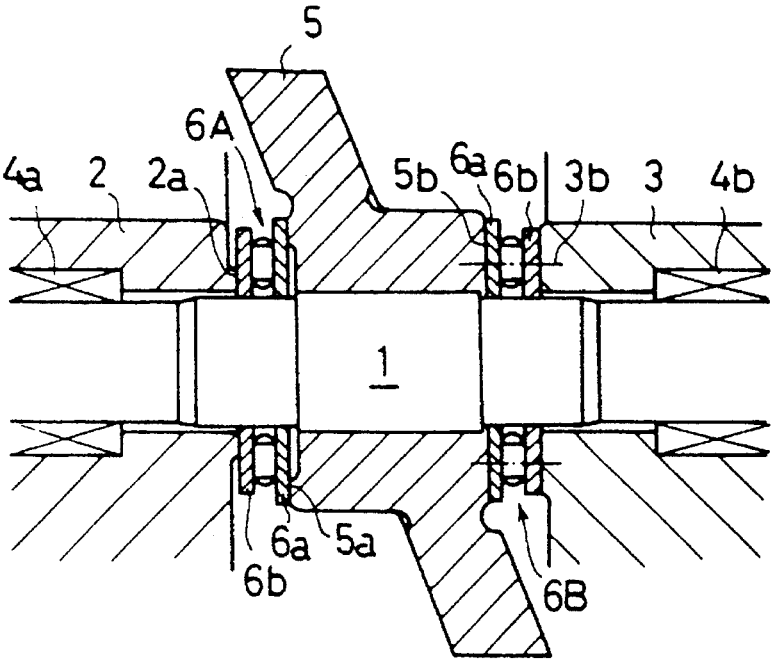
FIG. 2 is a partial cross-sectional view of the compressor shown in FIG. 1.

A swash plate type compressor according to a first embodiment of the present invention will be described in detail with reference to FIG. 1.

The swash plate type compressor incorporates a pair of cylinder blocks 2 and 3. A drive shaft 1 is rotatably supported by the pair of cylinder blocks 2 and 3. A swash plate 5 is mounted on the drive shaft 1. Thrust bearings 6A and 6B are respectively intervened between the swash plate 5 and the cylinder blocks 2 and 3. Each of the thrust bearings 6A and 6B has an annular inner race 6*a* and an annular outer race 6*b*. The inner race 6*a* has a different diameter from that of the outer race 6*b*.

The outer ends of both cylinder blocks 2 and 3 are blocked by housings 14 and 15. Bolts 16 securely fix the individual cylinder blocks 2 and 3 and the housings 14 and 15, so that the individual thrust bearings 6A and 6B are held between the swash plate 5 and the cylinder blocks 2 and 3.

The support structure for the thrust bearings 6A and 6B will now be described in detail.

Flat pressure receiving surfaces 3*b* and 5*b* are respectively formed on the inner surface of the cylinder block 3 and the rear-side boss of the swash plate 5. The rear thrust bearing 6B is located between those pressure receiving surfaces 3*b* and 5*b*. The inner race 6*a* and outer race 6*b* contact the pressure receiving surfaces 5*b* and 3*b* in such a way to ensure that rear thrust bearing 6B is held in a stable and rigid fashion.

The front thrust bearing 6A functions as a buffer to absorb the axial load. To accomplish this function, an annular rib portion 5*a*, having a relatively large diameter, is formed on the front-side boss of the swash plate 5. The inner race 6*a* of the front thrust bearing 6A abuts on this rib portion 5*a* in the vicinity of its outer periphery. An annular rib portion 2*a* having a relatively small diameter is formed on the inner wall of the front cylinder block 2. The outer race 6*b* abuts on the rib portion 2*a* in the vicinity of its inner periphery.

At the time of assembling the swash plate 5, when the bolts 16 are fastened with the swash plate 5, a fastening force is applied to the thrust bearings 6A and 6B. Since the front thrust bearing 6A, located between the rib portions 2*a* and 5*a*, has different diameters in this embodiment, the races 6*a* and 6*b* can elastically deform. If an excessive bolt fastening force is applied, the excess force is absorbed by the front thrust bearing 6A. It is therefore unnecessary to finely adjust the bolt fastening force, thus simplifying the assembling work.

When the compressor runs and the pistons 7 reciprocate in accordance with the rotation of the swash plate 5, the refrigerant gas is compressed and its reaction force acts as an axial load on the thrust bearings 6A and 6B via the pistons 7 and the swash plate 5. According to this embodiment, however, the rear rigidly held thrust bearing 6B effectively suppresses undesired vibration of the swash plate 5 by transmitting the vibration to the cylinder block 3. This is due to the rigidity with which the rear thrust bearing is held. The variable axial load is absorbed efficiently by the buffer function of the front thrust bearing 6A.

Figure 3:
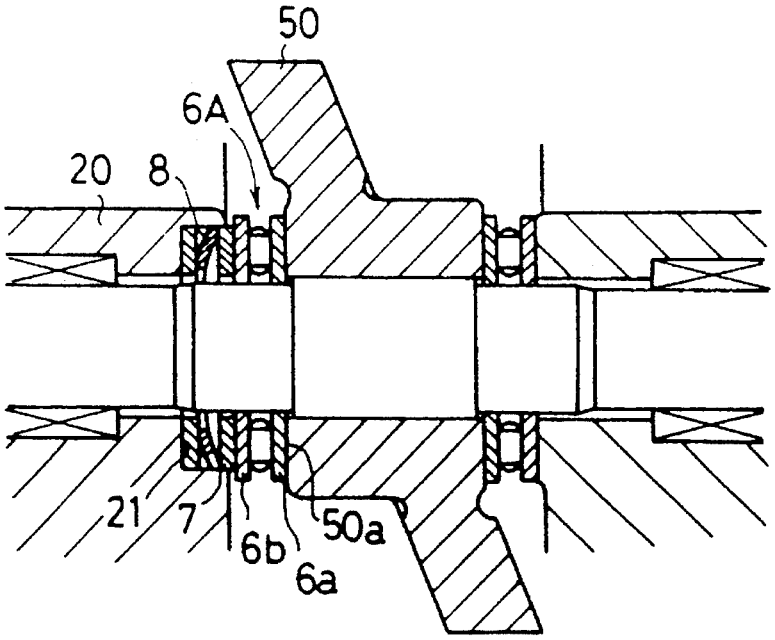
FIG. 3 is a fragmentary enlarged cross-sectional view of a compressor according to a second embodiment.

FIG. 3 shows a second embodiment of this invention. This embodiment differs from the first embodiment in the structure of the thrust bearing 6A. The front-side boss of a swash plate 50, like the rear-side boss, has a flat pressure receiving surface 50*a*. This surface 50*a* is in close contact with the inner race 6*a* of the front thrust bearing 6A.

A front cylinder block 20 has a recess 21 located around the outer periphery of the drive shaft 1. A washer 7 and a belleville spring 8 are retained in this recess 21 so as to be located on the outer periphery of the drive shaft 1. The washer 7 is located between the outer race 6*b* of the front thrust bearing 6A and the belleville spring 8. This spring 8 therefore urges the front thrust bearing 6A toward the swash plate 50.

According to this embodiment, as described above, instead of the thrust bearing 6A incorporating the buffer function, the belleville spring 8 functions as the buffer. The buffer function can be easily adjusted by properly setting the spring constant of the belleville spring 8.

Although the front thrust bearing has the buffer function in the above-described embodiments, the rear thrust bearing may have the buffer function instead. The belleville spring may be replaced with a coil spring or the like.

Figure 4:
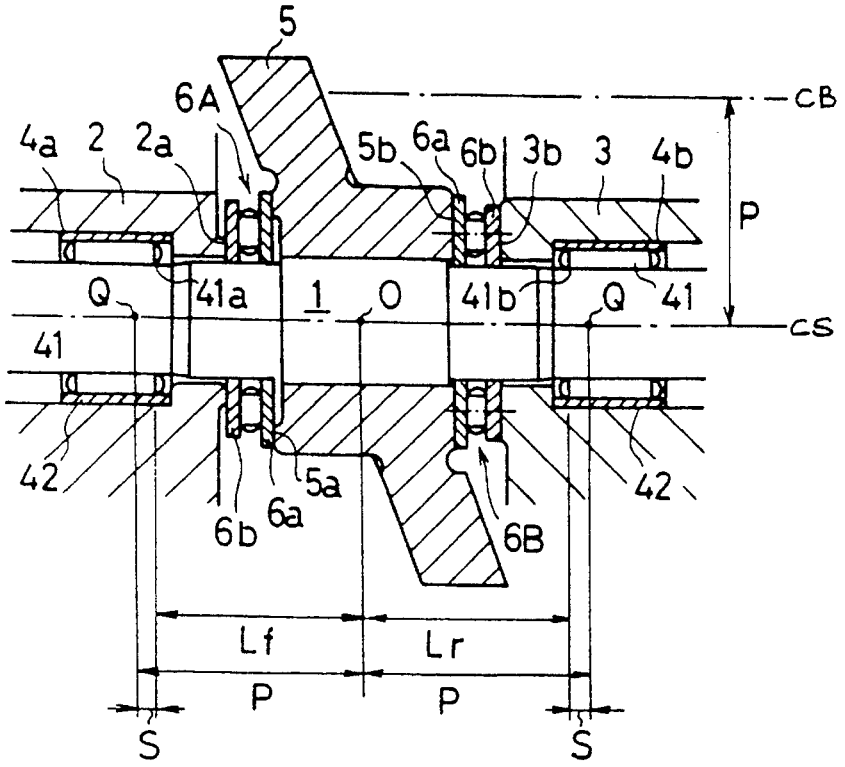
FIG. 4 is a fragmentary enlarged cross-sectional view of a compressor according to a third embodiment.

In a compressor of a third embodiment shown in FIG. 4, each of the cylinder blocks 2 and 3 has a plurality of bores 30 (see FIG. 1) around the drive shaft 1 to accommodate the pistons 7 respectively. The bores 30 are laid out along the pitch circle of a radius P.

As shown in FIGS. 1 and 4, center lines CB of the cylinder bores 30 are arranged on a pitch circle, which is depicted around the center line CS of the drive shaft 1 and has the radius P (mm). Each piston 7 has a pair of shoes 51 located on the associated center line CB of the cylinder bore 30. Each shoe 51 slides relatively on the swash plate 5 and moves forward together with the piston 7 substantially on the center line CB of the cylinder bore 30 according to the rotation of the swash plate 5. Accordingly, the reaction force generated by the compression of the gas by the pistons is transmitted to the swash plate 5 via the pistons 7 and the shoes 51.

A pair of radial bearings 4*a* and 4*b* each includes a plurality of rollers 41 and an outer ring 42 which accommodates those rollers. The rollers 41 are in contact with the drive shaft 1. The radial bearings 4*a* and 4*b* are located apart from each other at equal distances from the center O in the boss portion of the swash plate 5. In FIG. 4, individual points Q respectively indicate positions on the center axis of the drive shaft 1. Each point Q is apart from the center O by a distance corresponding to the radius P.

Given that the lengths from the center O to the inner ends 41*a* and 41*b* of the rollers 41 of the radial bearings 4*a* and 4*b* are respectively denoted by Lf and Lr, those lengths are set to Lf =Lr in this embodiment. The distance, S, between each point Q and the inner end 41*a* or 41*b* of the roller 41 is set as follows.

$$S=P-Lf=O-Lr=3 \text{ mm}$$

The compressor of this embodiment has an advantage of effectively suppressing unwanted vibrations of the swash plate 5 and the drive shaft 1 in addition to the function and advantages of the compressor of the first embodiment. This advantage occurs due to the following factor. The balanced drive shaft 1 is supported by the pair of radial bearings 4*a* and 4b located at equal distances from the center O. The reaction force generated by the compression of gas acts on the peripheral portion of the swash plate 5 at points separated from the axial center of the drive shaft 1 by a distance corresponding to the radius P of the bore pitch. The reaction force causes a first moment around the center O, which acts on the entire swash plate 5.

This reaction force also acts on the drive shaft 1 via the swash plate 5. As mentioned above, the drive shaft 1 is stably supported by the pair of radial bearings 4a and 4b. However, the reaction force from the radial bearings 4a and 4b generates a second moment around the center O, which is directed in the opposite direction to that of the first moment and is equal in magnitude to the first moment. Both moments therefore cancel out each other, thus effectively suppressing the vibrations of the swash plate 5 and the drive shaft 1.

To prove the above assumption, the following test was conducted for the present invention.

This test was conducted to check the vibrations along the longitudinal direction of a 10-cylinder compressor with five double-headed pistons under the following conditions.

| | |
|---|---|
| Length from the inner ends of the radial bearings 4a and 4b to the outer ends: | 12 mm |
| Number of rotations of compressor: | 3500 r/min |
| High Output Pressure: | 2.0 MPa |
| Low Output Pressure: | 0.05 MPa |

A 10-cylinder compressor often generates a vibration of the order that is a multiple of "5". When the number of rotations of this compressor is 3500 r/min (58 Hz), resonance frequently occurs in the vicinity of 300 Hz (about 5 times 58 Hz) in the vehicle on which the compressor is mounted.

The vibration of the compressor and in particular, the difference between lengths Lf and Lr (i.e. Lf–Lr) were studied under conditions where the length Lf changed and where length Lr remained constant. That is length Lf, from the center O to the inner end 41a of the front radial bearing 4a, changed while the length Lr from the center O to the inner end 41b of the rear radial bearing 4b and the pitch radius P were kept at a constant (P–Lr=3 mm). The results of the study are illustrated in FIG. 5.

Figure 6:
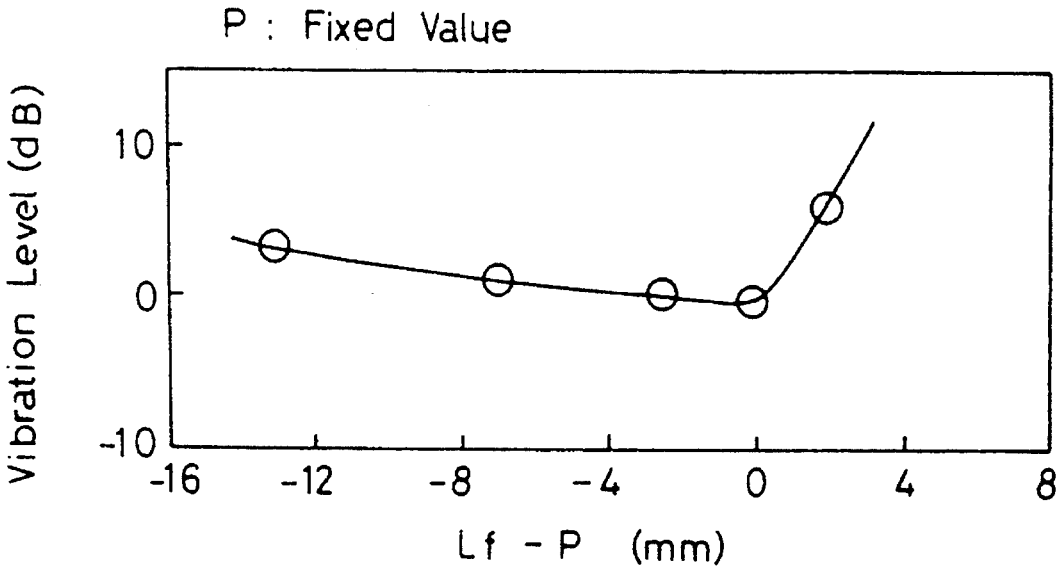
FIG. 6 is a graph showing the relation among the length Lf from the center of the swash plate in the compressor of the third embodiment to one of the radial bearings, the pitch P of bores, and the vibration level.

In general, both lengths Lf and Lr were altered while the pitch radius P was kept at a constant. Specifically, the lengths Lf and Lr were set equal to each other, and the relation between the difference between the length Lf and the pitch radius P (Lf–P_ and the vibration of the compressor was studied. The results are illustrated in FIG. 6.

Figure 5:
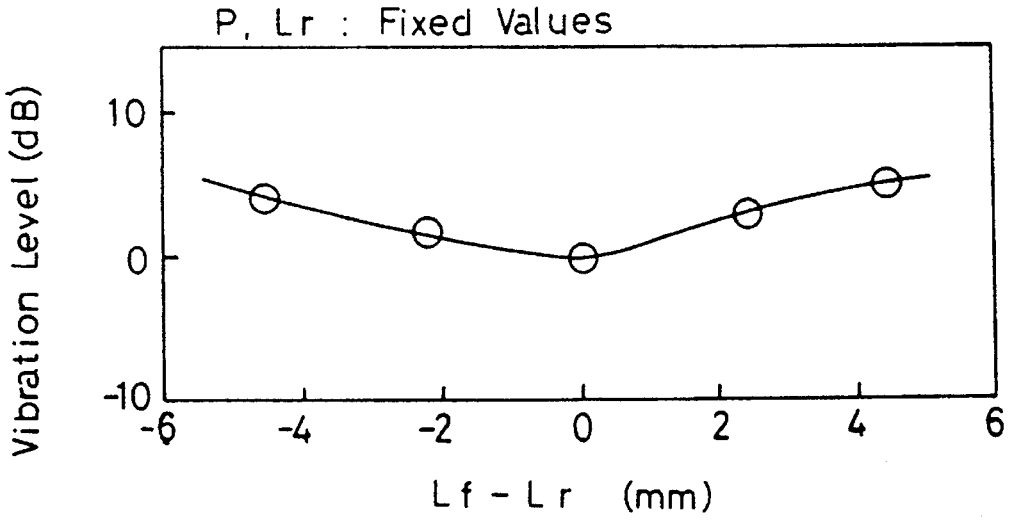
FIG. 5 is a graph showing the relation among the lengths, Lf and Lr, from the center of the swash plate in the compressor of the third embodiment to a pair of radial bearings, and the vibration level.

As apparent from FIG. 5, when Lf–Lr=0 or Lf=Lr, the vibration level was confirmed to reach a minimum. It is also apparent from FIG. 6 that when Lf–P=0 or Lf (=Lr)=P, the vibration level was minimized.

It was confirmed that as the difference (Lf–P) increased from 0, i.e., as the lengths from the center O to the inner ends 41a and 41b of the radial bearings 4a and 4b became longer than the pitch radius P, the vibration level increased sharply. This phenomenon might have originated from the bending of the drive shaft 1 between the radial bearings 4a and 4b caused by the increased lengths of both radial bearings 4a and 4b. As the difference (Lf–P) became smaller than 0, i.e., as the lengths Lf and Lr from the center O to the inner ends 41a and 41b of the radial bearings 4a and 4b became shorter than the pitch radius P, the vibration level gradually increased. It was also confirmed that when the difference (Lf–P) lay within a range of 0 to −12 mm or when each point Q was located in the range of the length of each radial bearing 4a or 4b, the vibration level could be reduced. From the viewpoint of design, it is particularly desirable that Lf–P=Lr–P=0 to −5 mm.

Figure 7:
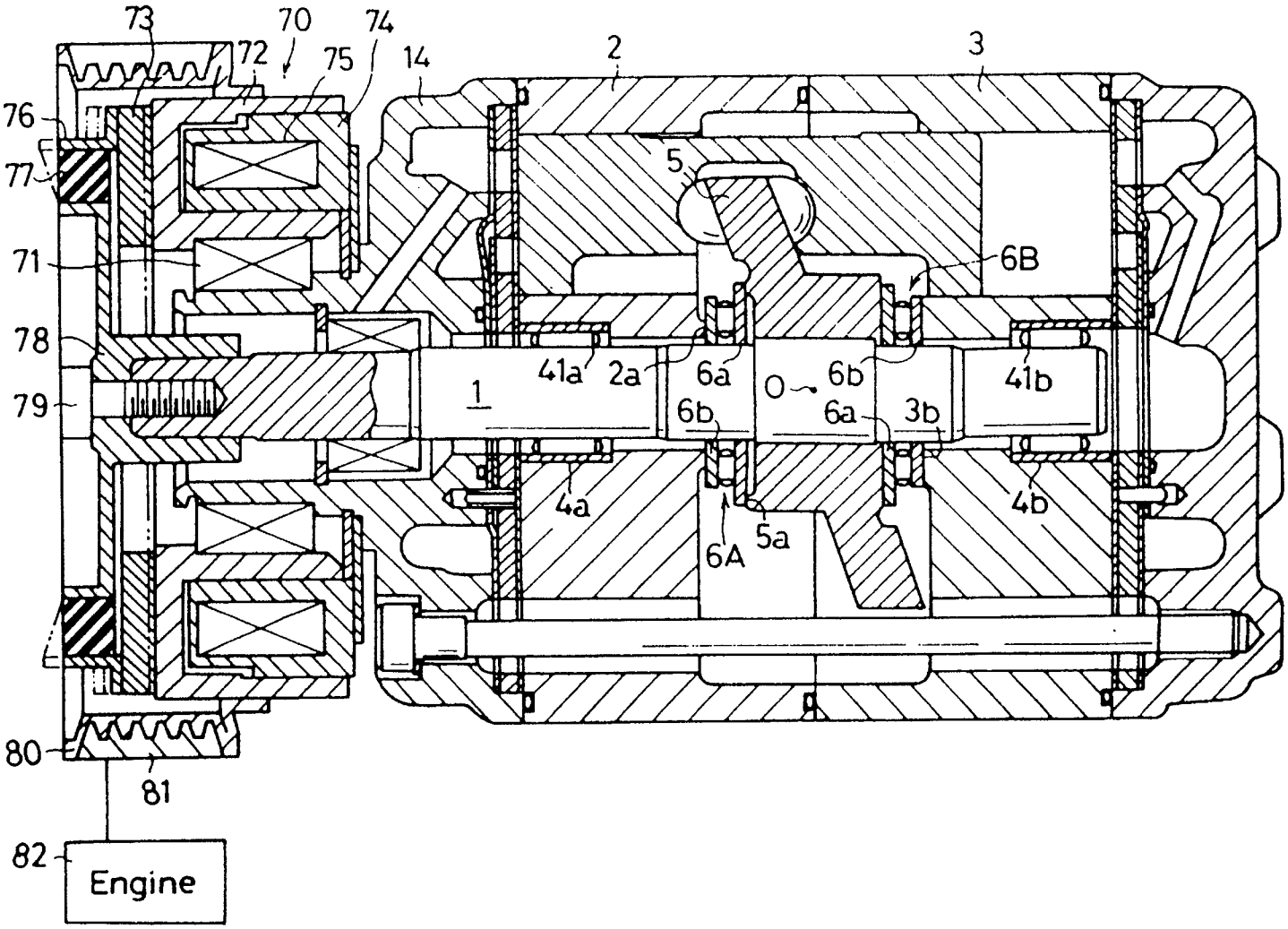
FIG. 7 is a cross-sectional view of a compressor according to a fourth embodiment.
Figure 8:
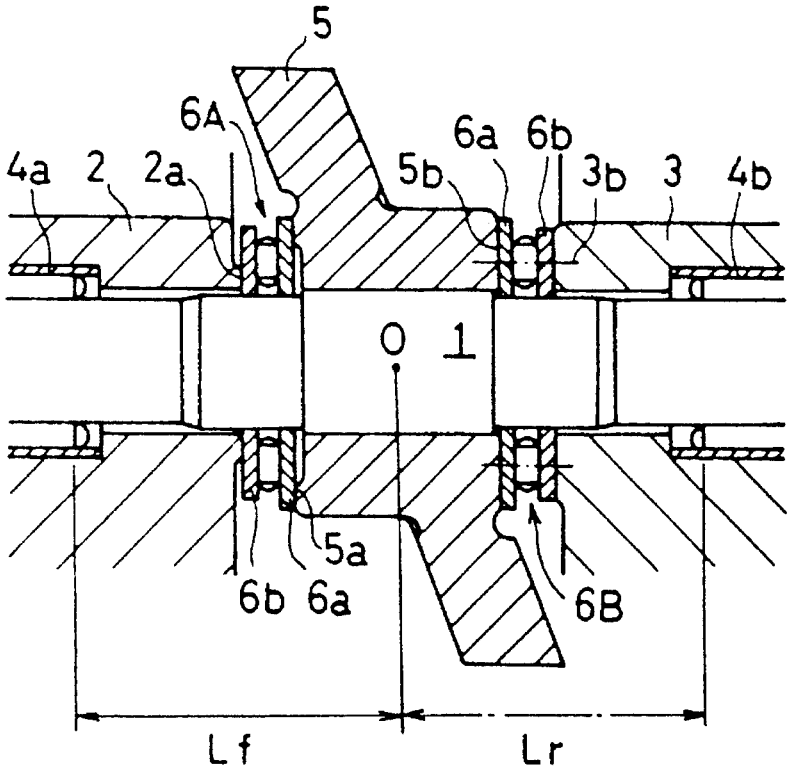
FIG. 8 is a fragmentary enlarged cross-sectional view of the compressor shown in FIG. 7.

In a compressor according to a fourth embodiment shown in FIGS. 7 and 8, the length Lf from the center O of the swash plate 5 to the inner end 41a of the roller of the front radial bearing 4a is longer than the length Lr from the center O to the inner end 41b of the roller of the rear radial bearing 4b. Further, the front radial bearing 4a is located at the front portion of the front cylinder block 2, with its front end located on the front end surface of this cylinder block 2. The distance between both radial bearings 4a and 4b is set within a predetermined range which can provide stable support for the drive shaft 1. The drive shaft 1 therefore will not tilt or bend between both radial bearings.

An electromagnetic clutch 70 is coupled to the distal end of the drive shaft 1. This electromagnetic clutch 70 has a stator housing 74, a rotor 72 and an armature 73. The stator housing 74, which has the shape of a hollow ring, is secured to the front housing 14. An excitation coil 75 is retained inside the stator housing 74.

The rotor 72 is mounted in such a way as to cover the inner and outer walls of the stator housing 74, and is rotatably supported by a bearing 71 installed in the front housing 14. A pulley 80 is secured to the outer periphery of the rotor 72 and is coupled to a vehicle's engine 82 by a belt 81. When the engine 82 is started, therefore, the pulley 80 and the rotor 72 rotate together via the belt 81.

A hub 78 is fixed to the distal end of the drive shaft 1 by a bolt 79. The armature 73 made of a magnetic material faces the front surface of the rotor 72 at a predetermined distance. The armature 73 is coupled to the periphery of the hub 78 via a rubber cushion 77 and a cylindrical fixture 76.

When the excitation coil 75 is excited, the armature 78 is pulled to the rotor 72 as indicated by the solid line in FIG. 7. As a result, the cushion 77 deforms against its own elasticity to the state indicated by the solid line in FIG. 7 from the state indicated by the two-dot chain line in the diagram along the axis of the drive shaft 1. At the same time, the pulley 80 is coupled together with the rotor 72 to the drive shaft 1 via the hub 78, the fixture 76 and the cushion 77. When the pulley 80 rotates under this situation, the rotation is transmitted to the drive shaft 1 to run the compressor.

With the coil 75 deactivated, the armature 78 and the fixture 76 are separated from the rotor 72 by the restoring force of the cushion 77, as indicated by the two-dot chain line in FIG. 7. This cuts off the power transmission between the pulley 80 and the drive shaft 1.

During the operation of the compressor, the armature 73 is attracted to the rotor 72 due to the elastic deformation of the rubber cushion 77 as mentioned above. Therefore, the restoring force of the cushion 77 acts on the drive shaft 1 via the hub 78. This restoring force pushes the drive shaft 1 backward.

According to this embodiment, however, this restoring force can be reliably received by the rear thrust bearing 6B. As a result, the pressure that acts on the pressure receiving surfaces 5b and 3b is slightly greater at the thrust bearing 6B of the compressor with the above type of electromagnetic clutch than the one at the thrust bearing of a compressor which has a different type of electromagnetic clutch. This improves the rigidity of the bearing 6B. It is therefore possible to effectively suppress the unstable vibration of the swash plate 5.

The distance between both radial bearings 4a and 4b is set within a predetermined range which can provide stable support for the drive shaft 1, as mentioned above, and the front radial bearing 4*a* is located as close to the electromagnetic clutch 70 as possible in the front housing. This arrangement suppresses the bending of the drive shaft 1 between the electromagnetic clutch 70 and the front radial bearing 4*a*. This arrangement also suppresses the whirling of the drive shaft 1 and the vibration of the electromagnetic clutch 70 due to the centrifugal force of the clutch 70.

In place of the front thrust bearing 6A having the buffer function, the combination of the front thrust bearing 6A and the belleville spring 8 as employed in the second embodiment may be adapted to the third and fourth embodiments.

Figure 9:
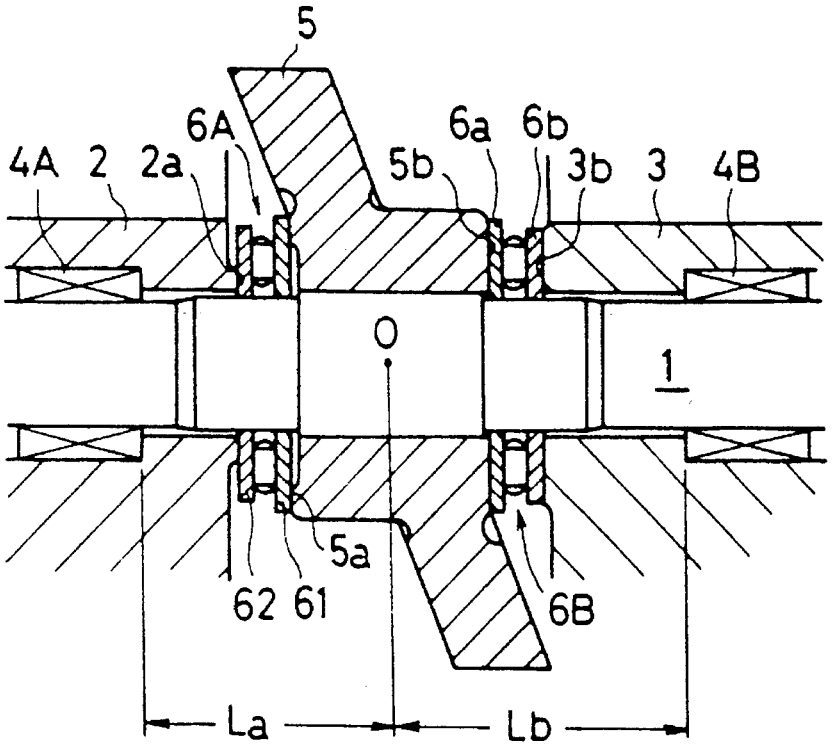
FIG. 9 is a fragmentary enlarged cross-sectional view of a compressor according to a fifth embodiment.
Figure 10:
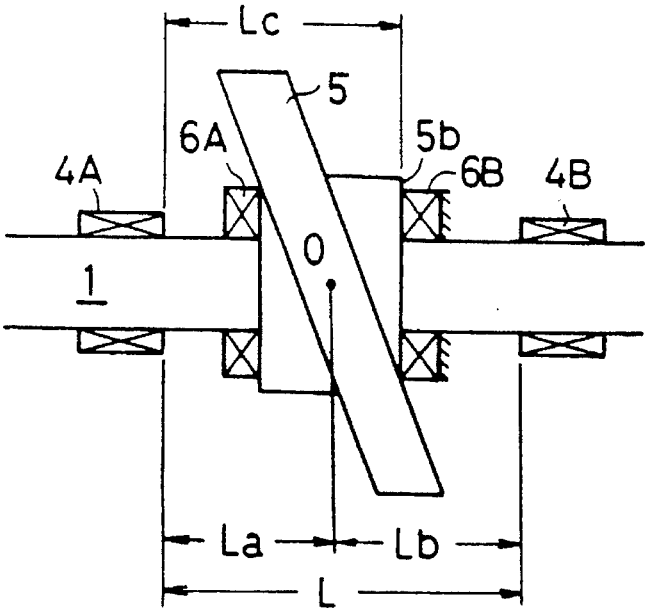
FIG. 10 is a fragmentary reduced front view showing the relation between the swash plate and bearings of the compressor in FIG. 9.

FIGS. 9 and 10 illustrate a fifth embodiment. A compressor according to this embodiment has thrust bearings 6A and 6B and their support structure, which are substantially the same as those of the compressor of the first embodiment. Like or same reference numerals are therefore given to the corresponding or identical components to avoid repeating their descriptions. The compressor of the fifth embodiment differs from the previous embodiments in the arrangement of the radial bearings. The structure of the radial bearings will be described below with reference to FIGS. 9 and 10.

In supporting the drive shaft 1 with the swash plate 5 by a pair of radial bearings, generally, the amount which drive shaft 1 bends becomes greater as the distance L between a pair of radial bearings 4A and 4B increases. The inclination of the drive shaft 1 increases as this distance L becomes shorter, as described earlier. In light of the above, an optimimum value for the distance L is set. Normally, distance L is bisected so that the lengths La and Lb from the center O of the boss portion of the swash plate 5 to the radial bearings 4A and 4B are set equal to each other. Accordingly, the distance Lc from the pressure receiving surface 5*b* of the swash plate 5 to the front radial bearing 4A is naturally determined by the sizes of the swash plate 5 and the thrust bearing 6A.

However, the moment that acts on the swash plate 5 is principally received by the rigid rear thrust bearing 6B, the drive shaft 1 and the front radial bearing 4A. Consequently, the bending of the drive shaft 1 or the load on the rear thrust bearing 6B tends to increase in proportion to the distance Lc.

According to this embodiment, to suppress the above tendency, the distance La from the center O of the swash plate 5 to the radial bearing 4A is set shorter than the distance Lb from the center O to the other radial bearing 4B. Thus, the distance Lc is set as short as possible. Consequently, this embodiment has an advantage of being capable of reducing the load on the rear thrust bearing 6B to suppress the wearing of the thrust bearing 6B, in addition to the advantages of the first embodiment.

Figure 11:
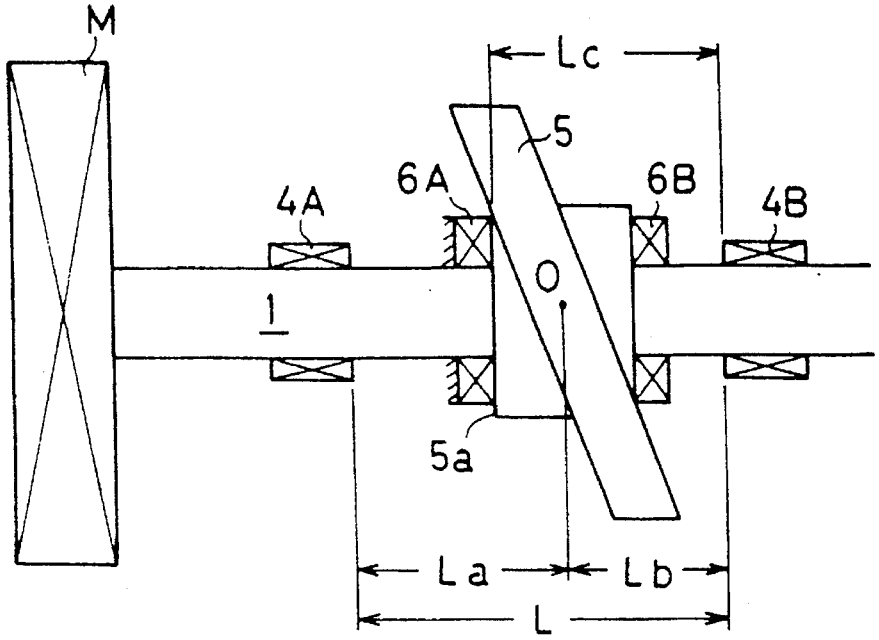
FIG. 11 is a fragmentary front view of a compressor according to a sixth embodiment.

FIG. 11 illustrates a sixth embodiment of this invention. In a compressor according to this embodiment, the distance Lb from the center O of the swash plate 5 to the radial bearing 4B is set shorter than the distance La from the center O to the other radial bearing 4A in contrast with the fifth embodiment, thereby shortening the distance Lc. The rigid front thrust bearing 6A contributes to shorten the distance Lc. Consequently, this embodiment can reduce the load on the front thrust bearing 6A and can set the bearing 6A close to an electromagnetic clutch M (see the fourth embodiment), thereby suppressing the vibration of the electromagnetic clutch M.

Figure 12:
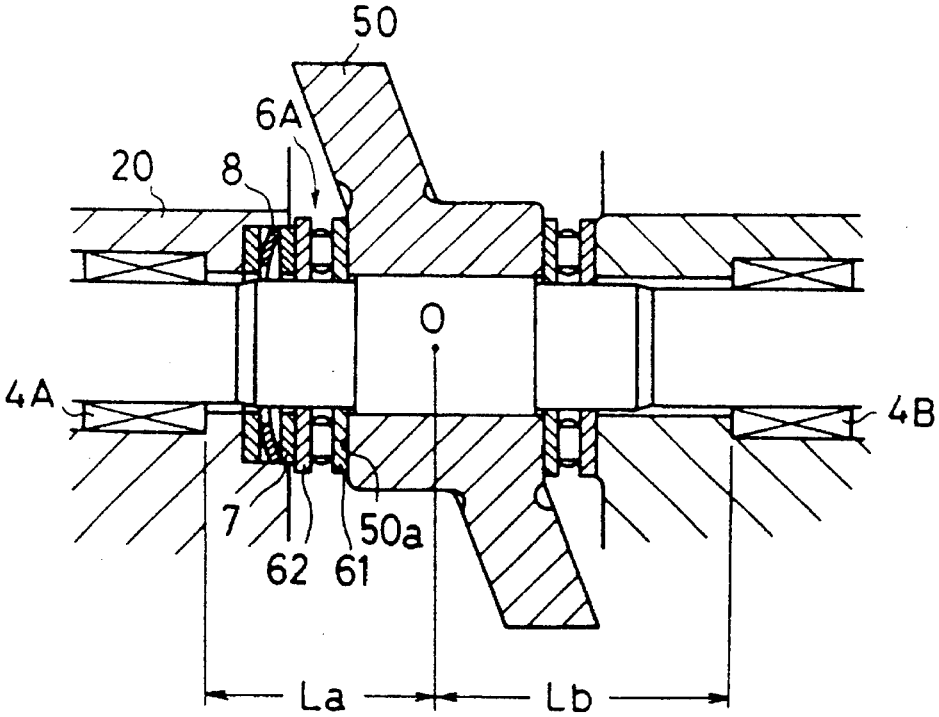
FIG. 12 is a fragmentary cross-sectional view of a compressor according to a seventh embodiment.
Figure 13:
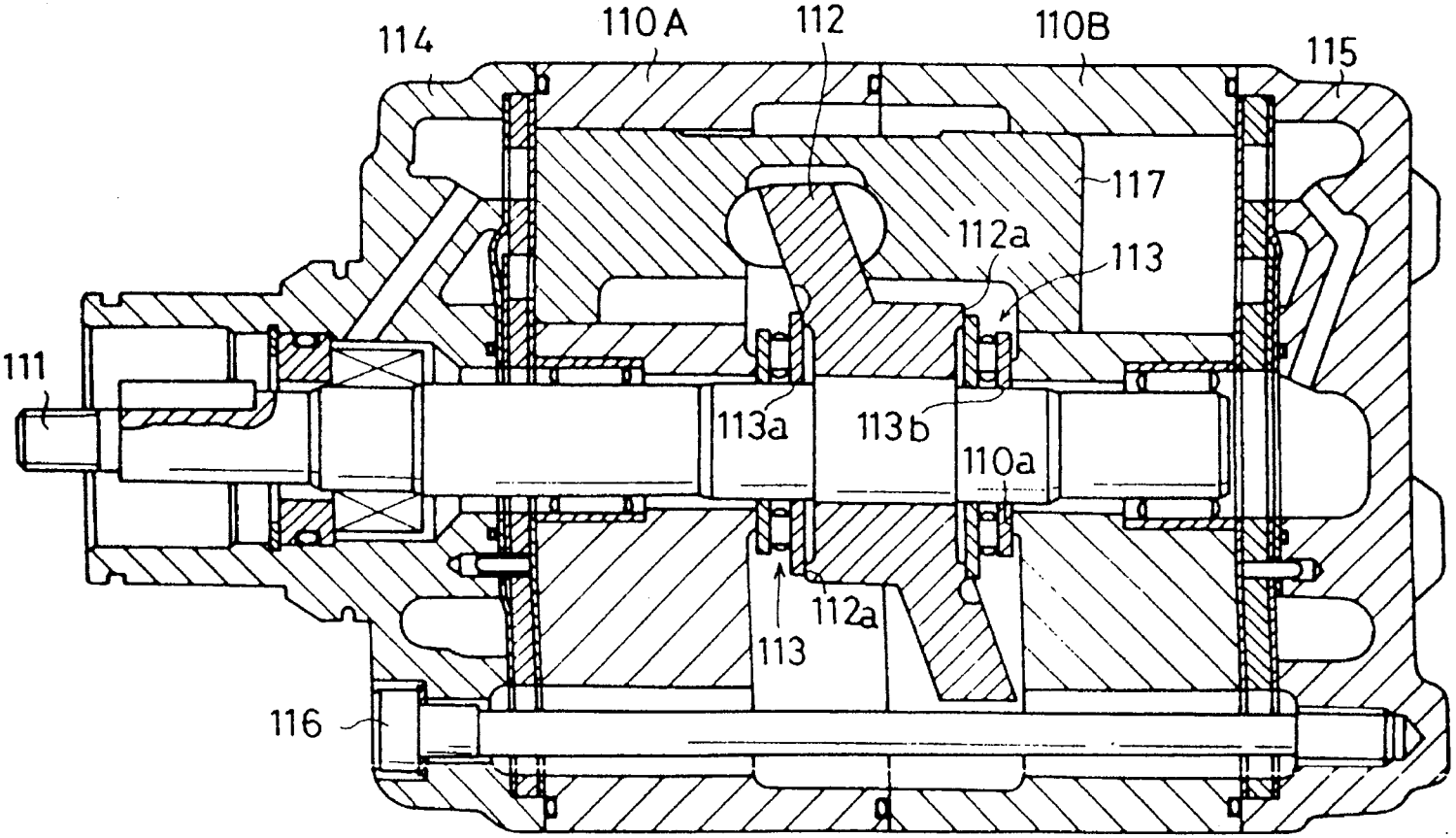
Fig.13 (Prior Art)
FIG. 13 is a cross-sectional view of a conventional compressor.
Figure 14:
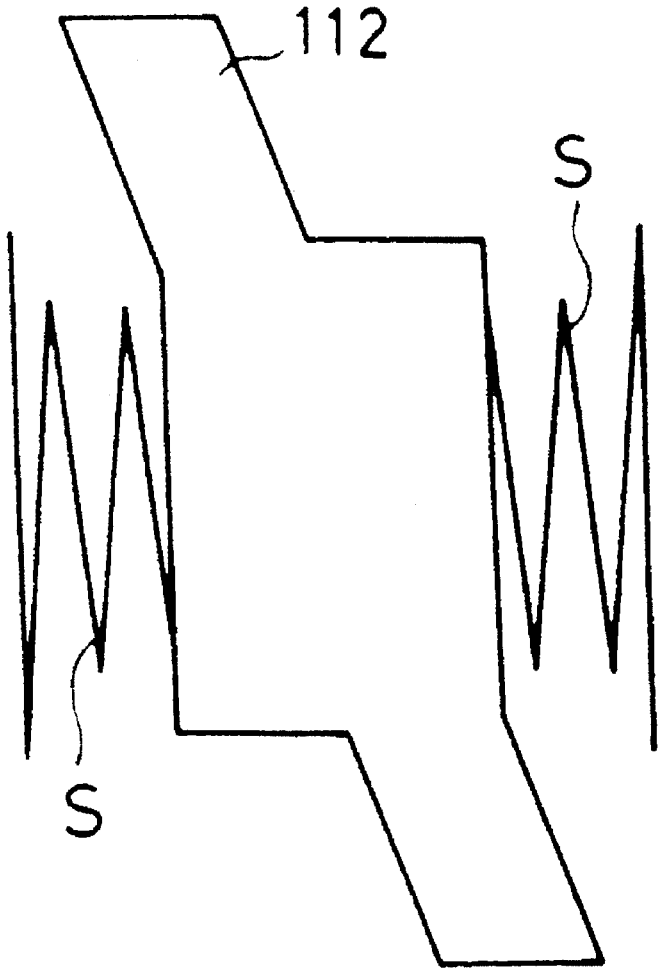
Fig. 14 (Prior Art)
FIG. 14 is a fragmentary front view of the compressor in FIG. 13.

FIG. 12 illustrates a seventh embodiment which is a combination of the fifth embodiment in FIG. 9 and the second embodiment in FIG. 3. The front thrust bearing 6A is pressed against the flat pressure receiving surface 50*a* of the swash plate 50 by the belleville spring 8 via the washer 7. The distance La from the center O to the front radial bearing 4A is set shorter than the length Lb from the center O to the rear radial bearing 4B. The compressor of the seventh embodiment therefore has the functions and advantages of both compressors of the second and fifth embodiments.

Therefore, the present examples and embodiments are to be considered as illustrative and not restrictive and the invention is not to be limited to the details given herein, but may be modified within the scope of the appended claims.

What is claimed is:

1. A compressor having a swash plate supported on a drive shaft for an integral rotation, said swash plate being coupled to a plurality of pistons reciprocally moveable in a cylinder block to compress gas therein, wherein reaction force of the compressed gas applied to the piston and causing axial load acting on the swash plate and the drive shaft is buffered by buffer means, said buffer means comprising:

a first bearing interposed between a first surface of the swash plate and the cylinder block; and a second bearing interposed between a second surface of the swash plate and the cylinder block, wherein one of said bearings is arranged to be flexibly deformable to absorb the axial load while the other bearing is arranged to be rigid to receive the axial load and transmit the axial load to the cylinder block.

2. A compressor according to claim 1 further comprising:

a first rib portion projected from the cylinder block toward the first surface of the swash plate to surround the drive shaft;

a second rib portion projected from the first surface of the swash plate to oppose the first rib portion, said first and second rib portions having diameters different from each other; and said first thrust bearing including an outer race and an inner race, said outer race being arranged to engage the first rib portion pursuant to the axial load and deform, and said inner race being arranged to engage the second rib portion pursuant to the axial load and deform.

3. A compressor according to claim 2, wherein said second rib portion has the diameter larger than the diameter of the first rib portion.

4. A compressor according to claim 1, wherein said cylinder block has a recess for accommodating the first thrust bearing; and wherein said first thrust bearing includes an abutting portion for abutting against the first surface of the swash plate, and a spring accommodated in the recess to urge the abutting portion toward the first surface of the swash plate.

5. A compressor according to claim 4, wherein said spring includes a belleville spring through which the drive shaft extends.

6. A compressor according to claim 1 further comprising:

a first and a second radial bearings for rotatably supporting the drive shaft;

said drive shaft having an axis;

said swash plate having a center on the axis of the drive shaft; and said first and said second radial bearing being respectively disposed apart from the center by an equal distance.

7. A compressor according to claim 6 further comprising a plurality of cylinder bores for respectively accommodating the pistons, wherein said cylinder bores are arranged along a pitch circle around the axis of the drive shaft, and wherein the center is apart from the first radial bearing by a distance (Lf), said distance (Lf) being represented:

$$0 \leqq Lf-P < -12 \text{ mm}$$

where, P is a radius of the pitch circle.

8. A compressor according to claim 1 further comprising:

a power source for rotating the drive shaft;

a clutch mechanism disposed between the power source and the drive shaft, said clutch mechanism being arranged to transmit power from the power source to the drive shaft; and said first thrust bearing being disposed between the clutch mechanism and the swash plate.

9. A compressor according to claim 8, wherein said clutch mechanism includes:

a rotating member supported by the cylinder block, said rotating member being rotated by the power source;

an armature mounted on the drive shaft and capable of coupling to the rotating member, said armature being arranged to be coupled to the rotating member and connect the drive shaft to the rotating member for integral rotation of the drive shaft and rotating member; and a coupling member for coupling the armature to the rotating member.

10. A compressor according to claim 8 further comprising:

said drive shaft having an axis;

said swash plate having a center on the axis of the drive shaft; and a first and a second radial bearings for rotatably supporting the drive shaft, said first radial bearing being disposed adjacent to the clutch mechanism and being disposed apart from the center by a first predetermined distance, said second radial bearing being disposed apart from the center by a second predetermined distance greater than the first predetermined distance.

11. A compressor according to claim 8 further comprising:

said drive shaft having an axis;

said swash plate having a center on the axis of the drive shaft; and a first and a second radial bearings for rotatably supporting the drive shaft, said first radial bearing being disposed adjacent to the clutch mechanism and being disposed apart from the center by a first predetermined distance, said second radial bearing being disposed apart from the center by a second predetermined distance less than the first predetermined distance.

12. A compressor having a swash plate supported on drive shaft for an integral rotation, said swash plate being coupled to a plurality of pistons reciprocally moveable in a cylinder block to compress gas therein, wherein reaction force of the compressed gas applied to the piston and causing axial load acting on the swash plate and the drive shaft is buffered by buffer means, said buffer means comprising:

a first rib portion projected from the cylinder block toward a first surface of the swash plate to surround the drive shaft;

a second rib portion projected from the first surface of the swash plate to oppose the first rib portion, said first and second rib portions having diameters different from each other;

a first thrust bearing interposed between the first surface of the swash plate and the cylinder block, said first thrust bearing including an outer race and an inner race, said outer race being arranged to engage the first rib portion pursuant to the axial load and deform, and said inner race being arranged to engage the second rib portion pursuant to the axial load and deform; and a second thrust bearing interposed between a second surface of the swash plate and the cylinder block, wherein said second thrust bearing is arranged to be rigid to receive the axial load and transmit the axial load to the cylinder block.

13. A compressor according to claim 12 further comprising a plurality of cylinder bores for respectively accommodating the pistons, wherein said cylinder bores are arranged along a pitch circle around the axis of the drive shaft, and wherein the center is apart from the first radial bearing by a distance (Lf), said distance (Lf) being represented:

$$0 \leqq Lf-P < -12 \text{ mm}$$

where, P is a radius of the pitch circle.

14. A compressor according to claim 12 further comprising:

a power source for rotating the drive shaft;

a clutch mechanism disposed between the power source and the drive shaft, said clutch mechanism being arranged to transmit power from the power source to the drive shaft; and said first thrust bearing being disposed between the clutch mechanism and the swash plate.

15. A compressor according to claim 14, wherein said clutch mechanism includes:

a rotating member supported by the cylinder block, said rotating member being rotated by the power source;

an armature mounted on the drive shaft and capable of coupling to the rotating member, said armature being arranged to be coupled to the rotating member and connect the drive shaft to the rotating member for integral rotation of the drive shaft and rotating member; and a coupling member for coupling the armature to the rotating member.

16. A compressor according to claim 14 further comprising:

said drive shaft having an axis;

said swash plate having a center on the axis of the drive shaft; and a first and a second radial bearings for rotatably supporting the drive shaft, said first radial bearing being disposed adjacent to the clutch mechanism and being located apart from the center by a predetermined distance, said second radial bearing being disposed apart from the center by a second predetermined distance greater than the first predetermined distance.

* * * * *

UNITED STATES PATENT AND TRADEMARK OFFICE

CERTIFICATE OF CORRECTION

PATENT NO. : 5,528,976
DATED : June 25, 1996
INVENTOR(S) : H. Ikeda et al

It is certified that error appears in the above-indentified patent and that said Letters Patent is hereby corrected as shown below:

Column 4, change line 60 to read --S=P-Lf=P-Lr=3 mm--.

Column 5, line 48, "P (Lf-P_" should read --P (Lf-P)--.

Signed and Sealed this

Twenty-fourth Day of December, 1996

*Attest:*

Bruce Lehman

BRUCE LEHMAN

*Attesting Officer*

*Commissioner of Patents and Trademarks*